US006116599A

United States Patent [19]

Nelson et al.

[11] Patent Number: 6,116,599

[45] Date of Patent: Sep. 12, 2000

[54] CONVERTIBLE INTERFERENCE SLIDING BLOCK TYPE MANIPULABLE PUZZLE AND METHOD

[75] Inventors: Harry L. Nelson, Livermore, Calif.; Hiroshi Yamamoto, Ishikawa, Japan

[73] Assignee: Binary Arts Corporation, Alexandria, Va.

[21] Appl. No.: 09/199,055

[22] Filed: Nov. 24, 1998

[51] Int. Cl.[7] ..... A63F 9/08

[52] U.S. Cl. ..... 273/153 S; 273/283

[58] Field of Search ..... 273/153 S, 157 R, 273/153 R, 283, 287

[56] References Cited

U.S. PATENT DOCUMENTS

| | | | |
|---|---|---|---|
| D. 329,879 | 9/1992 | Chern . | |
| D. 362,471 | 9/1995 | Friedman . | |
| D. 395,468 | 6/1998 | Wagner . | |
| 3,809,407 | 5/1974 | Quigley . | |
| 3,829,101 | 8/1974 | Betzoldt . | |
| 3,841,638 | 10/1974 | Sinden . | |
| 4,303,246 | 12/1981 | Strongin | 273/153 S |
| 4,373,729 | 2/1983 | Hanson et al. . | |
| 4,402,510 | 9/1983 | Yokoi . | |
| 4,422,641 | 12/1983 | Collin . | |
| 4,470,601 | 9/1984 | Finn . | |
| 4,479,654 | 10/1984 | Moscovich | 273/153 S |
| 4,480,839 | 11/1984 | Waters, Jr. | 273/287 |
| 4,511,144 | 4/1985 | Roberts . | |
| 4,541,635 | 9/1985 | Shoptaugh . | |
| 4,674,749 | 6/1987 | Shaffer et al. . | |
| 4,813,679 | 3/1989 | Hoffman . | |
| 4,836,548 | 6/1989 | Chittenden . | |
| 4,880,238 | 11/1989 | Derouin . | |
| 4,927,150 | 5/1990 | Monoyios | 273/153 S |
| 5,018,743 | 5/1991 | Maier et al. | 273/153 S |
| 5,110,130 | 5/1992 | Aulicino . | |
| 5,205,557 | 4/1993 | Kuo . | |
| 5,267,732 | 12/1993 | Bowen et al. . | |
| 5,411,261 | 5/1995 | Jacques . | |
| 5,437,454 | 8/1995 | Friedman | 273/153 S |
| 5,470,065 | 11/1995 | Hilchie . | |
| 5,542,673 | 8/1996 | Lammertink . | |
| 5,732,947 | 3/1998 | Noack | 273/283 |

FOREIGN PATENT DOCUMENTS

| | | |
|---|---|---|
| 1186351 | 4/1985 | Canada . |

*Primary Examiner*—Steven Wong
*Attorney, Agent, or Firm*—Cahn & Samuels, LLP

[57] ABSTRACT

The manipulable puzzle of the present invention includes a housing, multiple sliding bars, and multiple movable pieces. The housing has a support surface with an area defined by walls. The sliding bars are retained on the support surface by overhangs extending from opposing walls such that the sliding bars are removable and can slide across the support surface. The sliding bars each have a channel and peak pattern through which the movable pieces are slid as the sliding bars are manipulated to provide adjacent channels for the movable pieces to move through.

18 Claims, 8 Drawing Sheets

FIG. 9
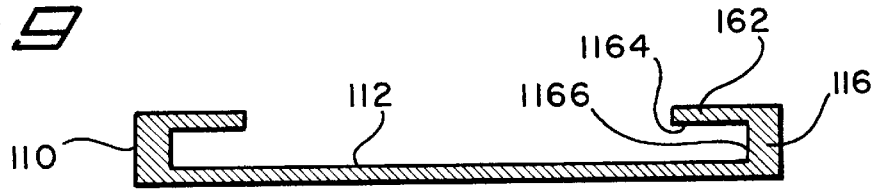
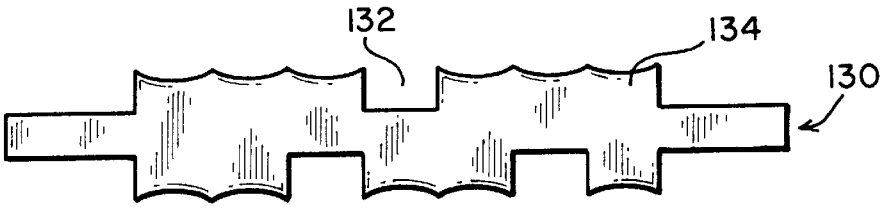
FIG. 10(a)
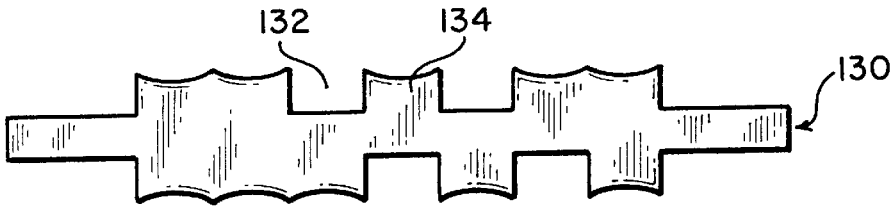
FIG. 10(b)
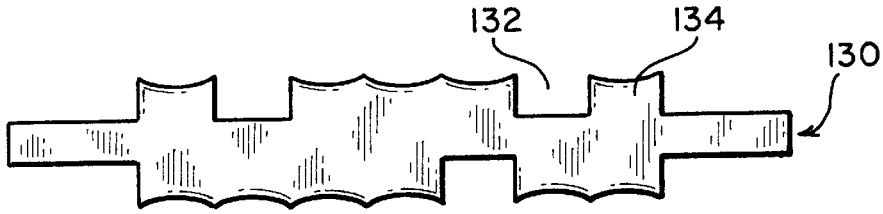
FIG. 10(c)
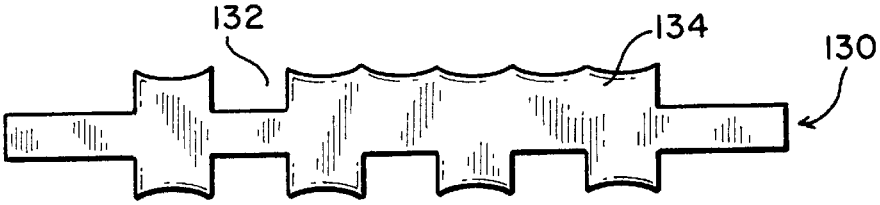
FIG. 10(d)

CONVERTIBLE INTERFERENCE SLIDING BLOCK TYPE MANIPULABLE PUZZLE AND METHOD

TECHNICAL FIELD

The present invention is directed to an improved puzzle with a housing, a plurality of replaceable, translatable, bi-directionally translatable sliding bars permitting selective positioning of a sliding bar relative to the housing for selected movement of slidable puzzle (movable) pieces relative thereto. More particularly, the sliding bars define a select pattern of channels adapted to receive the movable pieces and interfering peaks and permit restricted, sequential displacement of one or more selected pieces relative to the housing and sliding bars.

BACKGROUND OF THE INVENTION

Neatly packaged, multi-piece manipulable puzzles are popular for recreation and amusement. The interest for new and mentally challenging manipulable ("brainteaser") puzzles continues to grow, even in the face of the ubiquitous and increasingly sophisticated electronic amusement devices. "Brainteaser" inventions naturally augment recreation yet allow relaxed thoughtful self-improvement. A very popular form of manipulable puzzles is the portable and self-contained type, which allows the user to define the desired level of activity and interruption without necessarily disrupting the user's progress. Also such puzzles foster collateral benefits such as promoting analytical thinking by requiring the user to predict the result of each particular manipulation as well as some enhancement of hand-eye coordination.

Restricted movement sliding block puzzles are both well known and popular with puzzle enthusiasts. Likewise, manipulable blocking or interference puzzles are commercially available, attesting to their popularity. Puzzles of these types are exemplified respectively by RUSH HOUR® (see U.S. Pat. No. Des. 395,468) and SWITCHBACK® (see U.S. Pat. No. 5,437,454 and U.S. Pat. No. Des. 362,471), puzzles that are produced by Binary Arts, Inc. of Alexandria, Va.

The Japanese designed puzzle called "Crossing the River" produced by Bits & Pieces of Boston, Mass. is another example of this type of puzzle. This puzzle has a plurality of one-sided sliding bars with troughs through which a boat and logs are maneuvered. The housing for the puzzle is a framed rectangular playing surface on which the sliding bars are arranged. One of the drawbacks to this puzzle is that the movable pieces, sliding bars, and playing surface are not uniformly manufactured to provide a smooth fit between the various pieces and bars. Also, if there is a jolt or sudden movement to the puzzle, then the movable pieces and the sliding bars may become dislodged from the playing surface. A more important drawback exists in that the sliding bars are so chosen as to allow only a small number (six) of interesting puzzles.

Notwithstanding the usefulness of the above-described puzzles, a need still exists for a versatile, adjustable, self-retaining, precisely manufactured puzzle for handheld amusement, which allows a large number of interesting challenges of differing degrees of difficulty.

SUMMARY OF THE INVENTION

It is an object of the present invention to provide the advantages of a novel, manipulable puzzle for amusement and entertainment.

It is another object of this invention to provide a manipulable puzzle presenting differing degrees of difficulty.

Another object of this invention is to provide a manipulable puzzle having a multiplicity of interesting problem solutions.

Other objects of this invention are to provide a puzzle that is at once attractive and challenging.

Still further objects of this invention are to provide a unitary, self-contained puzzle.

The above objectives are accomplished by a manipulable puzzle that includes a housing having a support surface, a first set of opposing walls projecting from the support surface, and a second set of opposing walls projecting above the support surface, each of the walls of the second set forming an overlap spaced apart at a select distance from and extending substantially parallel to the support surface, the housing having a select length and a select width, the select length of the support surface corresponds to a first integer multiple of a unit, X, and the select width of the overhang corresponds to a second integer multiple of X, leaving a non-overhang portion of the support surface corresponding to a third number multiplied by X, at least two sliding bars contacting the support surface, the sliding bars capable of sliding across the support surface, the sliding bars having peaks and channels, each sliding bar having a select length, a select depth, and a select width, each select length of the sliding bars corresponds to a fourth integer multiple of X and each select width of the sliding bars corresponds to X, where the fourth integer is less than a first integer, each peak and channel has dimensions of X by a fifth integer multiple of X, and a plurality of movable pieces capable of communication with a channel of at least one of the sliding bars, each movable piece has a length corresponding to a sixth integer multiple of X and a width X, where the sixth integer is in a range of 1 to half of the first integer rounded up to the next integer.

The above objectives are also achieved by a puzzle that includes a plurality of movable pieces having a select width generally corresponding to X and a length corresponding to a small integer multiple of X, a plurality of sliding bars having a width generally corresponding to X and a length corresponding to nX where n is an integer greater than 3, each of the sliding bars also having a depth of Y, each of the sliding bars providing a select pattern of peaks and troughs where each peak has a width generally corresponding to X, a height generally corresponding to Y/3 and a length corresponding generally to an integer multiple of X, and a housing defining a recessed support surface bordered by upstanding walls, the support surface having a width generally corresponding to rX where r is an integer greater than 3 and a length corresponding to nX+2X, the housing permitting reciprocal translation in the direction of the sliding bar length over the support surface; and wherein the sliding bars being removable and positional on the support surface where the relative position of sliding bars may be rearranged to provide a select unique patterning of peaks and troughs.

The above objectives are met by a method of play using one of the above puzzles in the following manner removing at least one sliding bar from said housing, repositioning at least one sliding bar in said housing, inserting at least one sliding bar into said housing, placing at least one movable piece into at least one channel, and manipulating said sliding bars and said at least one movable piece.

Given the following enabling description of the drawings, the scope of the subject puzzle game invention should become evident to a person of ordinary skill in the art.

BRIEF DESCRIPTION OF THE DRAWINGS

FIG. 9 is a cross-section taken at 9—9 in FIG. 3.

FIGS. 10(*a*)–(*d*) are side views of slider bars of the embodiment of FIG. 1.

DETAILED DESCRIPTION OF THE PREFERRED EMBODIMENT

Figure 1:
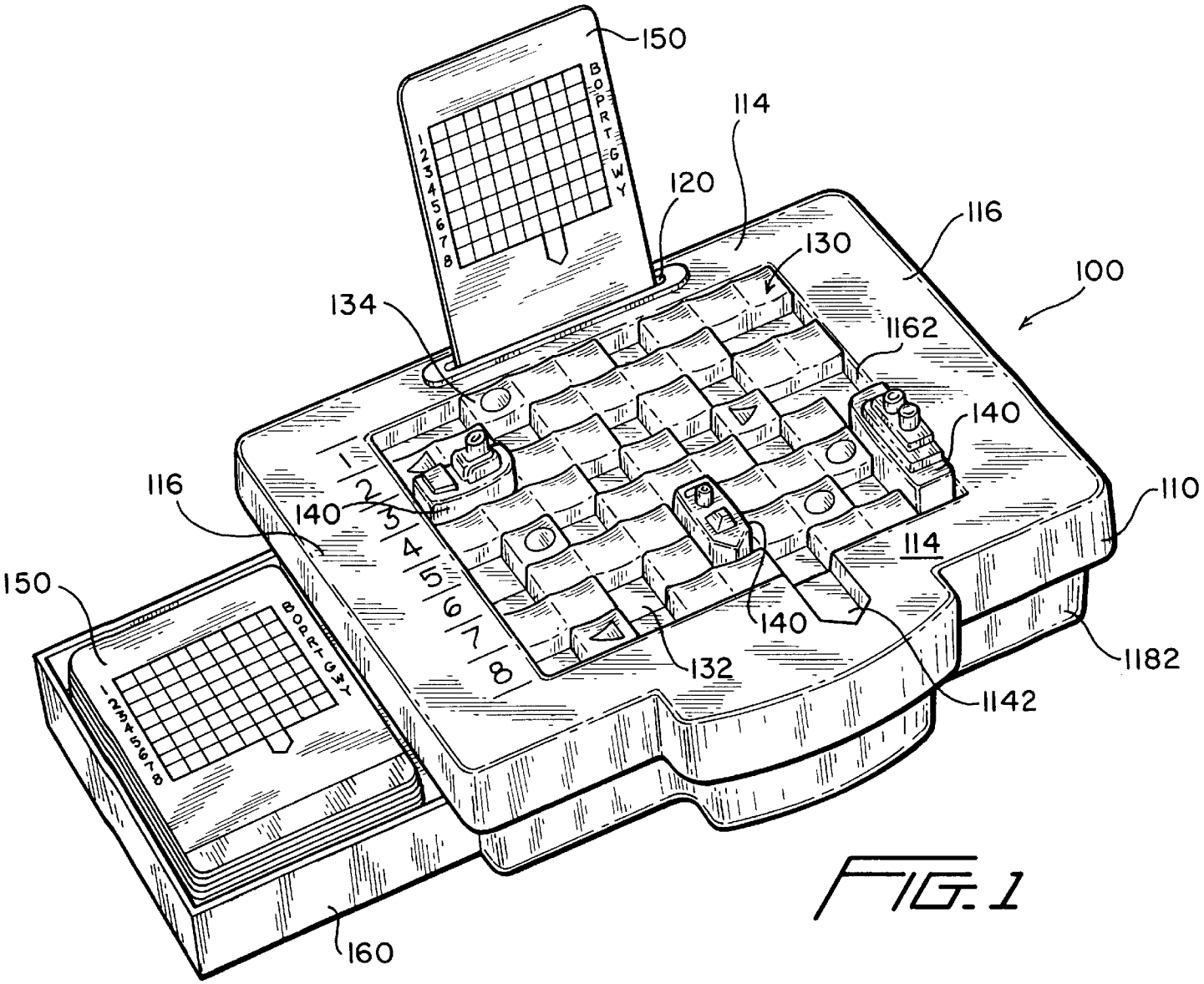
FIG. 1 is a perspective view of an embodiment of a manipulable puzzle device with storage drawer partially pulled out and a card placed in a card slot according to the invention.

FIGS. 1–13 depict an embodiment of a puzzle 100 according to the invention. In overview, the puzzle invention 100 includes a housing 110, a plurality of sliding bars 130, and a plurality of movable pieces 140. The housing 110 includes a support surface 112 bordered by four walls 114 and 116 with two opposite walls 116 having overhangs 1162 and one wall 114 having a recess 1142 above the support surface 112. The sliding bars 130 are slid across an open area of the housing 110 and retained on the support surface 112 during play by the overhangs 1162. Slide and slid are used as meaning movement by an object in a selected direction relative to a second object. Individual sliding bars 130 have channels 132 through which the movable pieces 140 move and thus are able to move across the sliding bars 130 to traverse a plane above the housing support surface 112.

The housing 110 is preferably formed from a rugged molded thermoplastic material such as high impact styrene and fabricated by conventional thermoplastic molding techniques such as injection molding or vacuum thermo-forming. The sliding bars 130 and movable pieces 140 also could be formed from a rugged molded thermoplastic material such as high impact styrene and fabricated by conventional thermoplastic molding techniques such as injection molding or vacuum thermo-forming. One of ordinary skill in the art will be able to appreciate that a variety of equivalent materials to thermoplastic could be used to make the housing 110, sliding bars 130, and the movable pieces 140.

The housing 110 is anticipated as being either a tabletop or handheld puzzle. The housing 110 in the preferred embodiment includes a support surface 112 framed by two sets of two opposing walls 114 and 116. In the preferred embodiment, these walls will extend vertically from the horizontal support surface. The first set of opposing walls 116 includes a retaining overhang 1162 extending substantially parallel to the support surface 112 and preferably connecting the second set of walls 114. In the preferred embodiment, the overhang 1162 is parallel to the support surface 112, for example, at a distance 2Y/3, where Y represents the height of sliding bars 130. The distance between the overhang bottom 1164 and the support surface 112, i.e., the height of wall 1166, is sufficient to allow the sliding bars 130 to slide underneath the overhang 1162. One of ordinary skill in the art, however, will realize that depending on the size of the overhang 1162, that the overhang 1162 could flare from the respective wall 116 at an angle greater than 90° to allow for easier insertion and removal of the sliding bars 130 from the housing 110. The second set of opposing walls 114 includes at least one recess 1142 for receiving a movable piece 140. The recess 1142 will have a depth to allow for communication with a channel 132 of an adjacent sliding bar to facilitate the sliding of the movable piece 140 into the recess 1142 from the channel 132.

The size of the support surface 112 between the second set of opposing walls 114 and the overhang walls 1166 of the first set of opposing walls 116 is an integer multiple of a unit, X. The unit's size is preferably in the range of 0.5 to 0.75 inches (1.27 to 1.91 cm), and is suggested for optimal play to be either 0.5 inches (1.27 cm) or 0.625 inches (1.58 cm). An example of the support surface 112 total size is 13×8 units. The overhangs 1162 each cover an area equal to 8×2 units of the support surface 112. The overhangs 1162 serve as a sliding bar retention flange and thus retain the sliding bars 130 during manipulation and play, they also permit the sliding bars 130 to be easily removable and reorganized such that different arrangements and patterns may be created with a set of sliding bars 130.

As shown in FIGS. 1 and 10(*a*)–(*d*), the sliding bars 130 in the preferred embodiment include a plurality of positions where each position is either a channel 132 or a peak 134. The sliding bars 130 are at least one unit wide and have a length equal to an integer multiple of the unit plus an equivalent number of units for the overhang on one side. For example, based on the size of the support surface 112 being 8×13 units, the sliding bars 130 each have a length of eleven units. Each position is 1×1 units. Each peak 134 has a curved top surface in the preferred embodiment to allow the user to more easily move and locate the sliding bars 130 between the walls of the first set of walls 116. Each channel 132 has a flat bottom surface at a uniform depth from the top of the neighboring peaks 134, which peaks 134 have a uniform height of Y/3 in the exemplary embodiment.

The positions on each end of the sliding bar 130 that are slid under the overhang 112 are channels 132. For example, based on the previous dimensions these end channels 132 are of a length slightly less than two units. The respective positions next to the end channel positions 132 are peaks 134, which in conjunction with the overhangs 1162 act as a stop for the sliding movement. The remaining positions can each be either a channel 132 or a peak 134. The preferred embodiment of the invention operates under the rule that each interior channel 132 is separated from another channel 132 by at least one peak 134, i.e., no two channels 132 are adjacent to each other, in the remaining positions. This rule increases the challenge and complexity of the overall puzzle. Thus the eleven unit long sliding bars 130 have thirteen possible variations from left to right operating under this rule for the middle five remaining positions of which twelve (including reflections) are shown in 10(*a*)–(*d*). The three positions on each end are two channels 132 and one peak 134. As shown in FIG. 10(*a*)–(*d*), the sliding bars 130 each have a bottom surface that allows for the sliding bar 130 to be slid between the first set of walls 116. As one of ordinary skill in the art will realize, when the bottom surface has a peak/channel arrangement thus allowing individual sliding bars to provide up to four different possible patterns to choose from, as shown in FIGS. 10(*a*)–(*d*), for a puzzle setup. If a surface of the sliding bar does not have a symmetrical arrangement of peaks and channel(s), then the surface provides two patterns by rotating the surface 180 degrees relative to the direction of the sliding bar elongation parallel to the plane of the support surface. The sliding bars 130 when arranged and placed in the housing 110 form a playing surface. The sliding bars 130 are arranged in a manner to allow channels 132 of adjacent sliding bars to be able to communicate with each other to facilitate the moving of the movable pieces 140.

The movable pieces 140 comprise the "interference" aspect of the inventive puzzle 100. The movable pieces 140 in the preferred embodiment are approximately one unit wide and have a length of, for example, from one to half of the shortest distance between the opposing walls of the second set 114. A one unit buoy, a two unit boat, a three unit boat, a four unit boat, and a second type of two unit boat are shown in FIGS. 11(*a*)–(*e*), respectively. One of ordinary skill in the art will realize that instead of ships indicating a nautical theme, the movable pieces could just as easily be blocks, cars, or any variety of shapes and designs depending on the puzzle theme. In the example embodiment, the longest movable piece is four units long as shown in FIG. 11(*d*). The movable pieces 140 are moved around the playing surface and across sliding bars 130 when adjacent sliding bars are moved such that at least one of their respective channels is in communication with each other.

As a result of the structure of the housing 110, movement of the slider bars 130 permits selective movement of the movable pieces 140 on the playing surface. The user moves a selected sliding bar in the example embodiment by placing a finger on the curved top face of a selected peak and sliding the respective sliding bar. Or in the alternative, the user may move a selected sliding bar(s) by placing a finger on a movable piece in a channel and pushing the movable piece to reciprocally move the sliding bar(s). The overhangs 1162 of the first set of walls 116 limit the degree of translation of the sliding bars 130. The illustrated embodiment contains a convenient slider bar translation limit equivalent to the overhang 1162. This structure also allows for the housing 110 to be used at an angle from the horizontal without the worry that the sliding bars 130 and/or movable pieces 140 will fall out as a result of the housing 110 being tilted.

Figure 13:
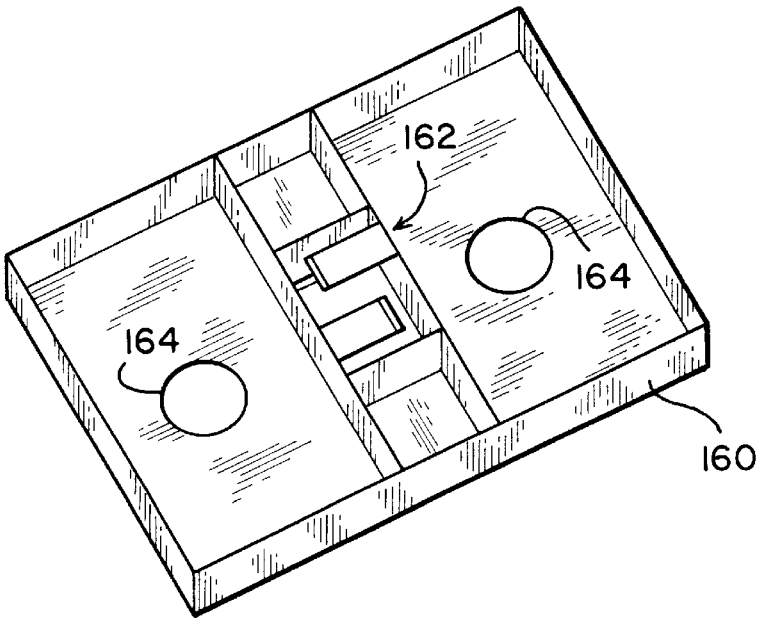
FIG. 13 is perspective view of the storage drawer removed from the manipulable puzzle device of the embodiment of FIG. 1.
Figure 11A:
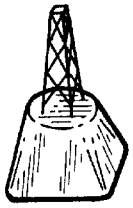
FIGS. 11(*a*)–(*e*) are perspective views of movable puzzle pieces of the embodiment of FIG. 1.
Figure 11B:
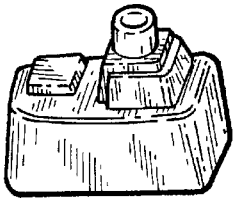
Figure 11C:
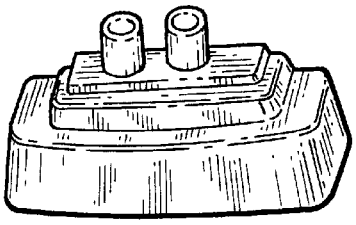
Figure 11D:
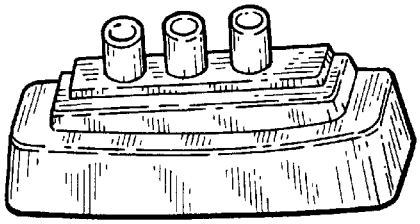
Figure 11E:
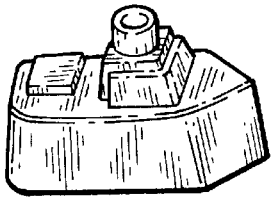
Figure 12:
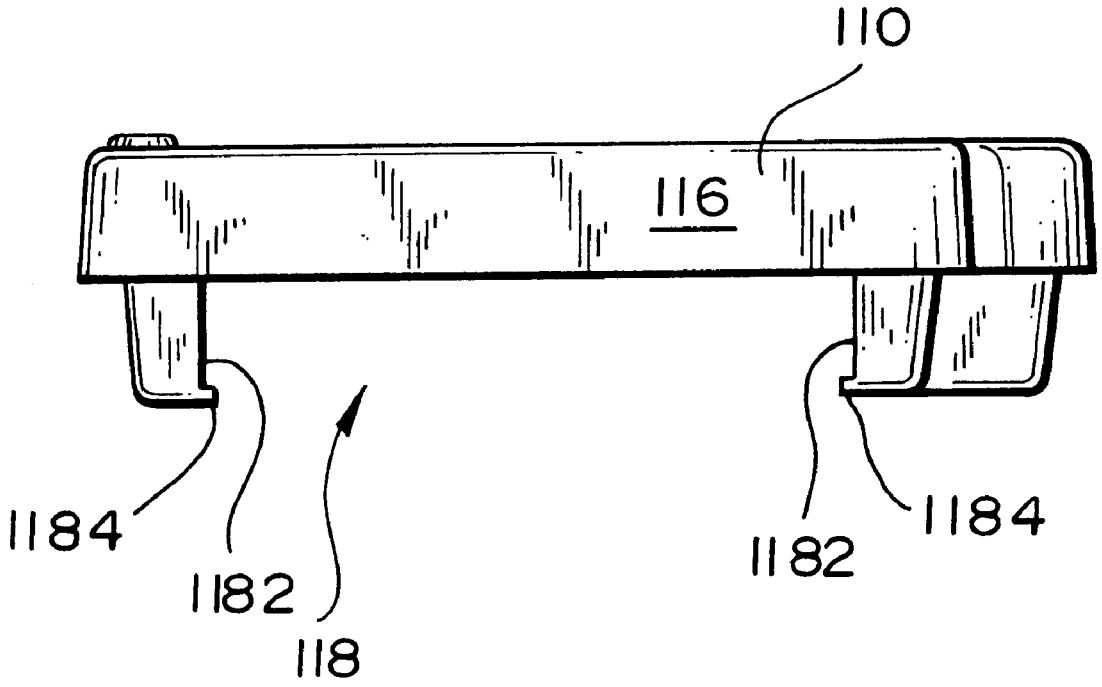
FIG. 12 is a left side view of the manipulable puzzle device housing without the storage drawer.

An alternative embodiment is that the housing 110 has a storage area 118 below the support surface 112. The storage area 118 includes a cavity to hold a storage drawer 160. It is envisioned that the cavity will have two walls 1182 extending vertically from below the support surface 112. Each wall 1182 will have a sliding ridge 1184 to engage and support the storage drawer 160. Or as shown in FIGS. 2 and 4–7, the sliding ridges may extend completely across the distance between the two walls 1182 and form a solid bottom 1184'. Either the depending walls 1182 or the support surface 112 will have an engagement means to engage and restrict movement of the storage drawer 160 when the storage drawer 160 is in a stored position (not shown) and in an extended position as shown in FIG. 1. To facilitate engagement with the housing 110, the storage drawer 160 has a clip mechanism 162 as shown in FIG. 13. The storage drawer 160 also is envisioned to have pullout holes 164. To facilitate a better hold and grip by the user, the storage area 118 will most likely have a smaller footprint than the support surface 112 and first and second set of walls 114 and 116.

The storage drawer 160 is envisioned as holding the movable pieces 140 when they are not in use. There will be at least two positions for the storage drawer 160, a stored position when it is completely within the cavity and an extended position when its partly pulled out to gain access to the storage drawer contents. The storage drawer 160 also could hold any instructions or playing cards 150 providing different puzzle start positions and the solutions to move a particular movable piece into the recess 1142 of the second set of opposing walls 114. If the storage drawer 160 contains both playing cards 150 and movable pieces 140, then the storage drawer 160 will have a third position where it is extended on a second side to allow additional access to the storage drawer 160. As shown in FIG. 13, the storage drawer 160 may be divided into sub-storage areas to separate types of movable pieces 140 from each other and/or from the playing cards 150. It is also conceivable that the storage area 118 may allow for storage of additional and extra sliding bars 130.

An additional feature for the housing 110 is a card slot 120 along the top edge to facilitate the placement of a particular, in use, playing card 150. The playing card 150 may show the initial puzzle setup on one side and the puzzle solution with steps from the initial puzzle setup to the solution on the other side.

Figure 3:
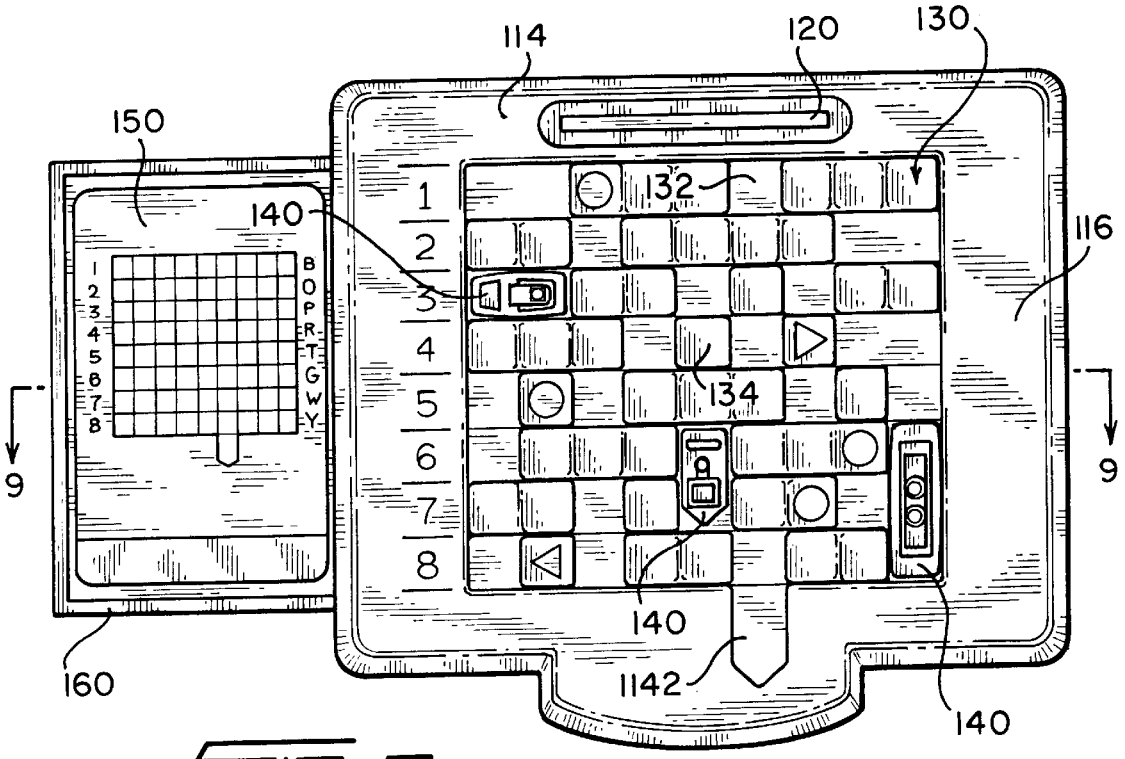
FIG. 3 is a top view of the embodiment of FIG. 1.
Figure 2:
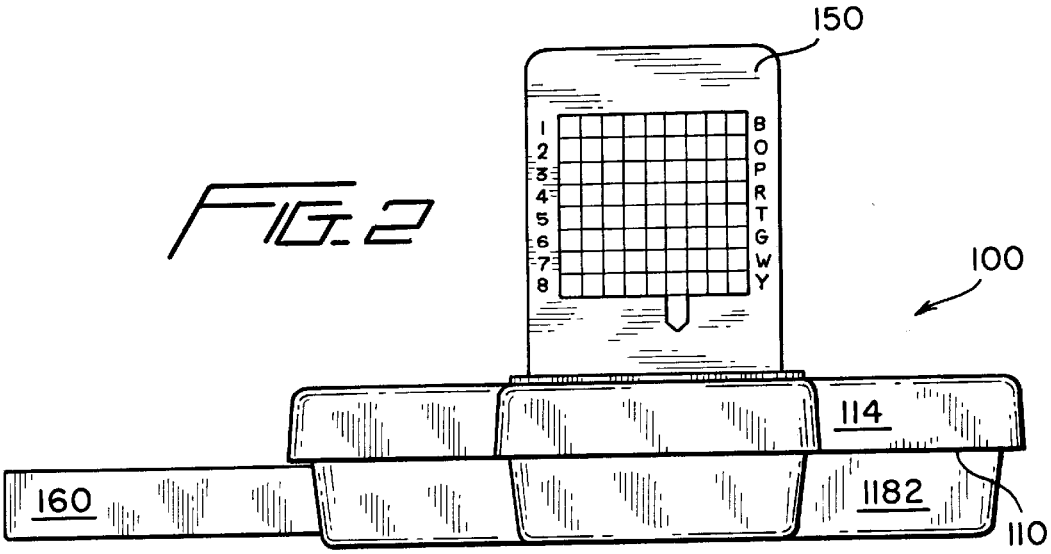
FIG. 2 is a front view of the embodiment depicted in FIG. 1.
Figure 4:
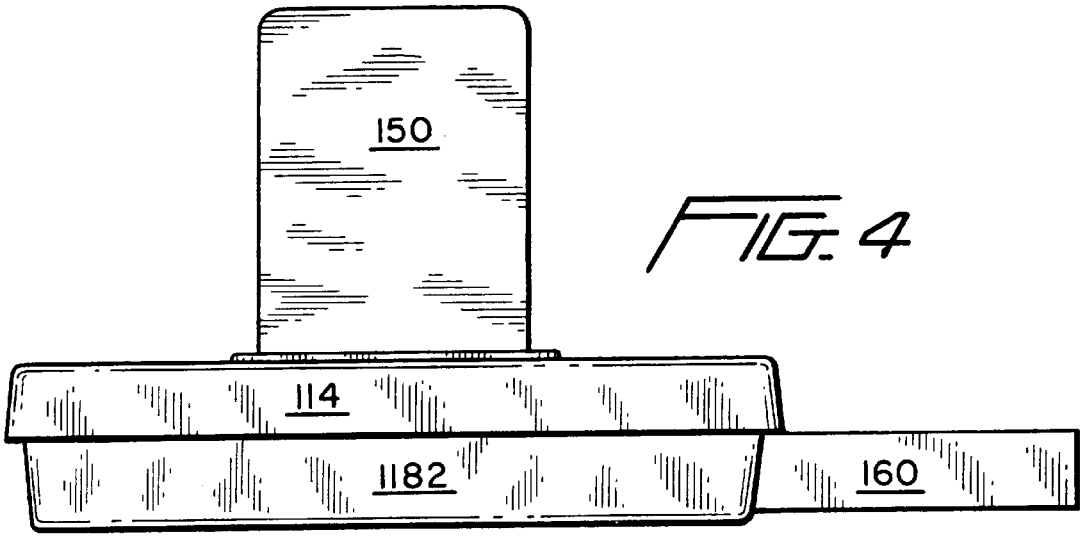
FIG. 4 is a rear view of the embodiment of FIG. 1.
Figure 5:
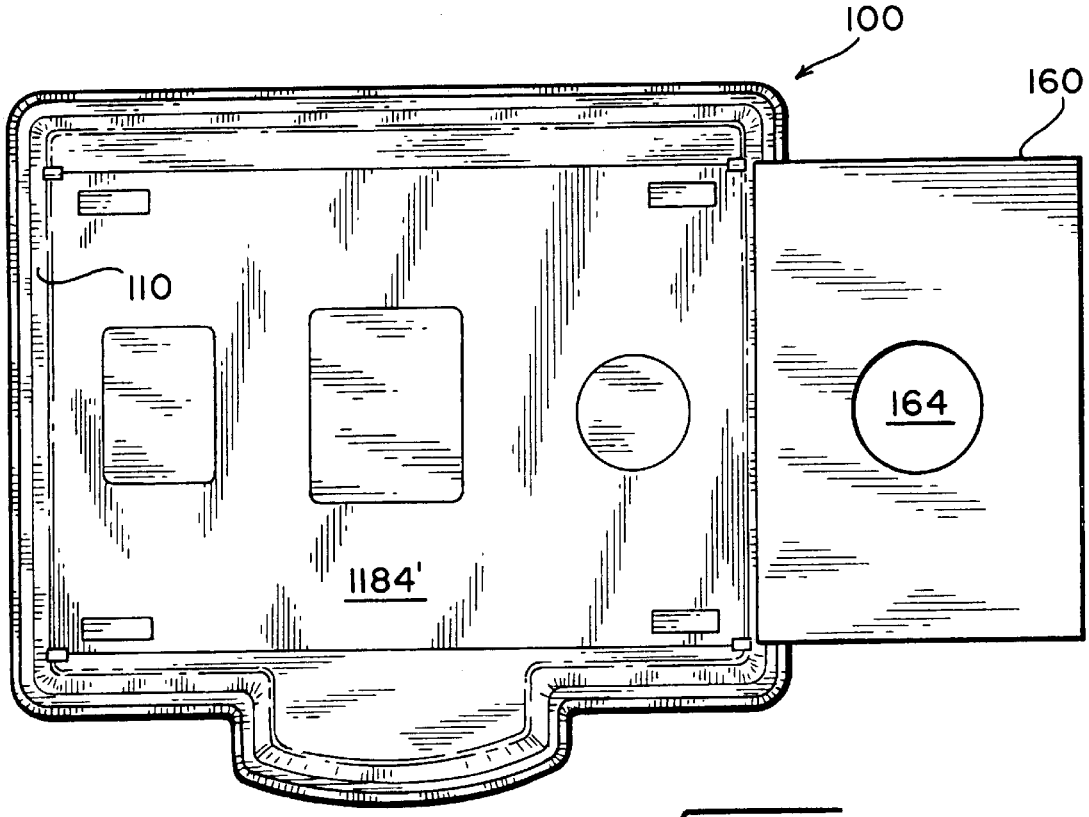
FIG. 5 is a bottom view of the embodiment of FIG. 1.
Figure 6:
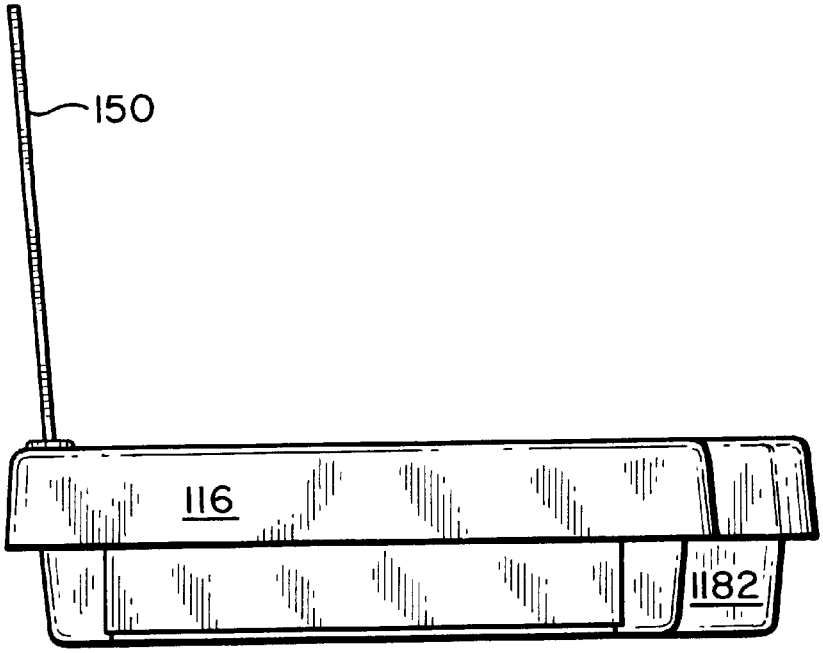
FIG. 6 is a left side view of the embodiment of FIG. 1.
Figure 7:
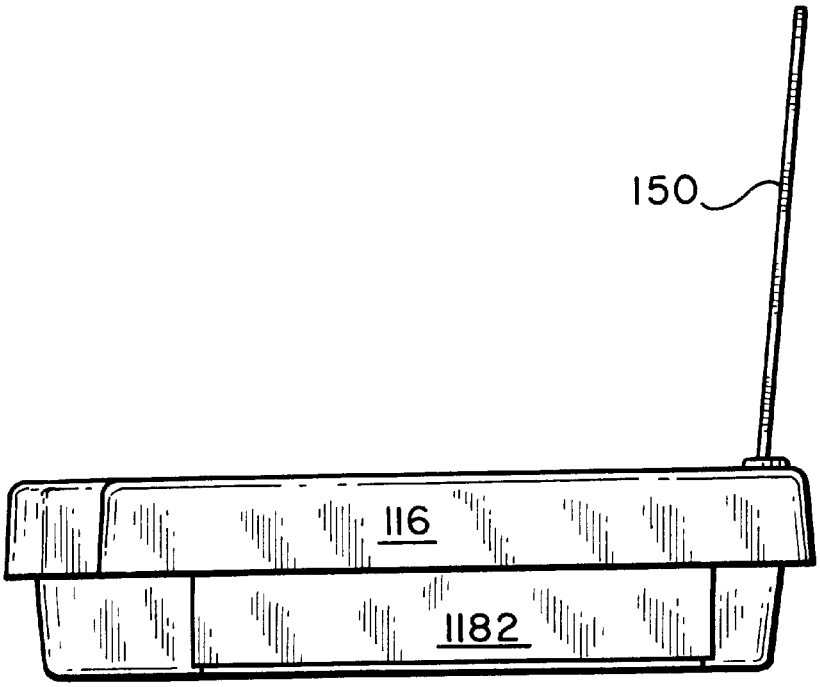
FIG. 7 is a right side view of the embodiment of FIG. 1.
Figure 8:
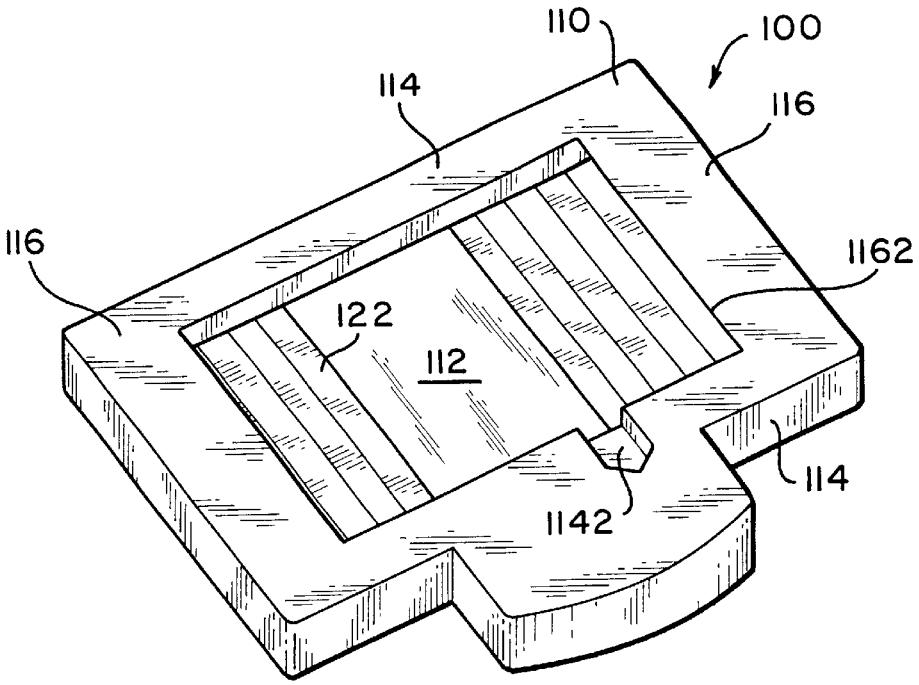
FIG. 8 is a perspective view of the manipulable puzzle device housing without slider bars and a storage area.

The slider bars 130 and movable pieces 140 can be color coded for easier setup of a puzzle and simplify the information needed to provide the solution steps. For example, the slider bars 130 could have shape and/or color codes representing a particular peak/channel arrangement. FIGS. 1 and 3 show the slider bars 130 with triangle and circle codes. The movable pieces 140 also can be manufactured in individual colors that simplify the playing card instructions and make the puzzle more visually appealing.

One of the movable pieces should be shaped differently from the other movable pieces. For example, each movable piece 140 could have a basic rectangular footprint, except for the selected piece that has a differentiated footprint that might, for example, have a more pointed bow as shown in FIG. 11(*e*). The footprint of the selected piece allows only it to fit into the recess 1142 of the second set of walls 114.

Another alternative embodiment is that the housing support surface 112 includes registers 122 that correspond to the bottom surfaces of the slider bars 130. The registration system allows the slider bars 130 to be slid preferably in incremental distances equal to a multiple of the unit. This arrangement provides for easier aligning of adjacent slider bars 130 and the channels 132 to allow movement of the movable pieces 140. The registers 122 will run between the second set of walls 114 and parallel to the first set of walls 116. The registers 122 preferably are located on both sides of the support surface 112 beginning at the free end of the overhang 1 162. The number of adjacent registers 122 is preferably equal to one plus the ledge overhang distance rounded up to the nearest integral multiple of units.

In this alternative embodiment, the registers 122 ideally will be curved with an arcuate or arc top that engages the peaks 134 on the bottom surface of the sliding bars 130 when the sliding bars 130 have the dual sided peak/channel arrangement, for example, as shown in FIGS. 10(*a*)–(*d*). The peaks 134 will have a corresponding curved top that extends in a direction parallel to the channels 132. This structure allows for the sliding bars 130 to readily and easily slide across the support surface 112, but yet have a variety of preferred locations to allow the user to easily align channels 132 in adjacent sliding bars.

The method of use or manipulation of the puzzle 100 should be apparent from the foregoing. During "play", e.g., manipulation of the movable pieces 140 through the pattern or on the playing surface, the user uses finger pressure to translate a selected sliding bar within the housing to move the channels in and out of alignment with the channels of an adjacent sliding bar. Once aligned, the user can move the movable pieces through the open channel. By selective manipulation of this type, the movable pieces 140 may be sequentially displaced or re-distributed on the playing surface to achieve a particular goal. The movable pieces 140 are to be moved in the channels only and not lifted over each other or peaks on the sliding bars 130 from initial puzzle setup to the position wherein the puzzle is solved. The puzzle is solved when a predetermined movable piece, which is sized to fit within the recess 1142, entirely enters the recess 1142 in the second set of walls 114.

Given the foregoing, variations and modifications to the invention should now be apparent to a person having ordinary skill in the art. The specific dimensions of the housing and of the respective structural features will be governed by the specific puzzle construct and need not be of particular significance so long as they adhere to the functional principals described above. Other potential variations include the number of sliding bars and the number of peaks/channels thereon. The particular geometry and arrangement of the housing, the sliding bars, etc. can be modified without departing from the scope of this invention. These variations and other modifications are intended to fall within the scope and spirit of the invention as defined by the following claims.

We claim:

1. A manipulable puzzle comprising:

a housing having a support surface, a first set of opposing walls projecting above said support surface, and a second set of opposing walls projecting above said support surface, each of said walls of said second set having an overhang spaced apart at a select distance from and extending substantially parallel to said support surface, said housing having a select length and a select width, at least two sliding bars contacting said support surface, said sliding bars capable of sliding across said support surface, said sliding bars having peaks and channels, each sliding bar having a select length, a select depth, and a select width where the width corresponds to X, and a plurality of movable pieces capable of communication with a channel of at least one of said sliding bars; and wherein the select length of said support surface corresponds to a first integer multiple of X and the select width of said support surface corresponds to a second integer multiple of X, each of said overhangs extends over said support surface by a distance corresponding to a third number multiplied with X, each select length of said sliding bars corresponds to a fourth integer multiple of X and each select width of said sliding bars corresponds to X, where the fourth integer is less than a first integer, each peak and channel has dimensions of X by a fifth integer multiple of X, and each movable piece has a length corresponding to a sixth integer multiple of X and a width of X, where said sixth integer is in a range of 1 to half of the first integer rounded up to the next integer.

2. The puzzle according to claim 1, wherein one wall of said first set of opposing walls has a recess with sufficient depth to receive one of said movable pieces from a channel of one of said sliding bars adjacent to said recess.

3. The puzzle according to claim 1, wherein said support surface includes a plurality of registers running between said first set of opposing walls, said registers engage a bottom surface of each of said sliding bars.

4. The puzzle according to claim 1, wherein each overhang connects said opposing walls of said first set.

5. The puzzle according to claim 1, wherein each of said sliding bars have two surfaces with peaks and channels.

6. The puzzle according to claim 1, further comprising a storage drawer in communication with said housing, wherein said housing having two wall depending from a bottom of said support surface, each of said walls including a guide rail extending from a lower edge to communicate with said storage drawer.

7. The puzzle according to claim 1, wherein said housing is generally shallow and rectangular and said sliding bars are translatable between said overhangs a selected distance generally equal to about two times X.

8. A puzzle comprising a plurality of movable pieces having a select width generally corresponding to X and a length corresponding to a small integer multiple X, a plurality of sliding bars having a width generally corresponding to X and a length corresponding to nX where n is an integer greater than 3, each of said sliding bars also having a depth of Y, each of said sliding bars providing a select pattern of peaks and troughs where each peak has a width generally corresponding to X, a height generally corresponding to Y/3 and a length corresponding generally to an integer multiple of X, and a housing defining a recessed support surface bordered by upstanding walls, said support surface having a width generally corresponding to rX where r is an integer greater than 3 and a length corresponding to nX+2X, said housing permitting reciprocal translation in the direction of said sliding bar length over said support surface; and wherein said sliding bars being removable and positional on said support surface where the relative position of sliding bars may be rearranged to provide a select unique patterning of peaks and troughs for manipulation of said movable pieces through said troughs when said unique pattern provides for alignment of troughs between at least two contiguous slider bars.

9. The puzzle according to claim 8, wherein said walls have a height equal to Y.

10. The puzzle according to claim 8, wherein at least one wall having a recess formed therealong where said recess is dimensioned to correspond to a select one of said movable pieces.

11. The puzzle according to claim 10, wherein said recess has a width generally corresponding to X, and a length of 2X, and a depth corresponding to a height of each peak.

12. The puzzle according to claim 8, wherein two opposing walls each have an overhang spaced apart at a selected distance from and parallel to said support surface.

13. The puzzle according to claim 12, wherein each overhang connects said opposing walls of said first set.

14. The puzzle according to claim 8, wherein each sliding bar has two surfaces with peaks and troughs.

15. The puzzle according to claim 8, further comprising a storage drawer in communication with said housing, wherein said housing having two walls depending from a bottom of said support surface, each of said walls including a guide rail extending from a lower edge to communicate with said storage drawer.

16. The puzzle according to claim 8, wherein said housing is generally shallow and rectangular and said sliding bars are translatable between said overhangs a selected distance generally equal to about two times X.

17. A method for using the puzzle of claim 1, comprising:

removing at least one sliding bar from said housing, repositioning at least one sliding bar in said housing, inserting at least one sliding bar into said housing, placing at least one movable piece into at least one channel, and manipulating said sliding bars and said at least one movable piece into the recess.

18. The method according to claim 17, further comprising rotating at least one sliding bar after removing said sliding bar from said housing.

* * * * *